United States Patent [19]

Kashio

[11] 4,125,995

[45] Nov. 21, 1978

[54] ELECTRONIC TIMEPIECE

[75] Inventor: Toshio Kashio, Tokyo, Japan

[73] Assignee: Casio Computer Co., Ltd., Tokyo, Japan

[21] Appl. No.: 787,150

[22] Filed: Apr. 13, 1977

[30] Foreign Application Priority Data

Apr. 13, 1976 [JP] Japan ..... 51-41633

[51] Int. Cl.[2] ..... G04B 27/00

[52] U.S. Cl. ..... 58/855; 58/50 R

[58] Field of Search ..... 58/4 A, 85.5, 34, 35 R, 58/33, 50 R

[56] References Cited

U.S. PATENT DOCUMENTS

| | | | |
|---|---|---|---|
| 3,855,780 | 12/1974 | Kashio | 58/4 A |
| 3,935,700 | 2/1976 | Van Haaften | 58/85.5 |
| 4,016,508 | 4/1977 | Kobori | 58/85.5 |
| 4,022,017 | 5/1977 | Aoki | 58/85.5 |
| 4,024,676 | 5/1977 | Yamamura | 58/85.5 |
| 4,024,678 | 5/1977 | Portmann | 58/85.5 |
| 4,044,544 | 8/1977 | Yagi | 58/85.5 |

*Primary Examiner*—Robert K. Schaefer
*Assistant Examiner*—William L. Feeney
*Attorney, Agent, or Firm*—Flynn & Frishauf

[57] ABSTRACT

In an electronic timepiece including a battery, a time count circuit for counting reference clock signals from an oscillator and a display unit for displaying the counted values of the time count circuit, there is provided a switching mechanism for controlling a function other than a time count function. A battery set signal which is generated upon incorporation of a battery into the body of the timepiece is temporarily held in a holding circuit.

The timepiece includes a switching circuit which, when the switching mechanism is operated, permits a switching operation signal for controlling a function other than the time count function to be switched by the output of a signal holding circuit to a switching operation signal for controlling a time setting function.

The timepiece further includes a counter in which the contents are counted by the latter switching operation signal. The output of the counter is delivered as an instruction for time counting. After the time count circuit completes its time setting operation, the signal holding circuit releases its hold state to permit the switching mechanism to return to the state of the normal time function.

20 Claims, 4 Drawing Figures

ELECTRONIC TIMEPIECE

BACKGROUND OF THE INVENTION

This invention relates to an electronic timepiece capable of effecting a time setting operation when a battery is incorporated into the body of the timepiece for replacement.

There have been realized, for example, a variety of digital display type electronic timepieces adapted to count output signals from a reference oscillator such as a crystal oscillator so as to perform a time counting operation. Such digital display type electronic timepieces can be easily designed to obtain an accurate time counting operation. It is easy to provide a good electronic timepiece with such a high accuracy that an error can be restricted only to below ±10 seconds in terms of a month. No frequent time adjusting operation is required, unlike an ordinary mechanically driven timepiece. It will be sufficient, therefore, that a time correction is normally made in time units of seconds. The electronic timepiece uses a battery as a power source and an accurate time counting operation continues unless the battery loses its effective service life.

Therefore, a time adjustment in time units of "hours" and "minutes" (and in the case of an electronic timepiece with a date display section, a date adjustment), although not required in the normal time counting operation, is restricted to such cases where a continuous time counting operation is interrupted or the memory contents in a time counting section are erased. That is, such time adjustments are restricted to the case where a battery is removed from the body of the timepiece. Therefore, it will be sufficient that a time adjustment is effected when a new battery is incorporated into the body of the timepiece.

It is accordingly the object of this invention to provide a digital display type electronic timepiece which, only when a new battery is incorporated into the body of the timepiece, necessitates effecting a time adjustment by a switching means normally used for the control of a time counting function and inhibits an unnecessary time adjustment during other times.

SUMMARY OF THE INVENTION

According to this invention there is provided an electronic timepiece including means for receiving a battery, a time count circuit for counting reference clock signals from an oscillator and a display unit for displaying the contents of the time count circuit. The timepiece further comprises switch means for controlling a time counting function except for a time setting function performed by said time count circuit, means for generating a battery set signal indicative of an initial state in which a battery is set into the battery receiving means of the timepiece, means for holding the battery set signal from the battery set signal generating means, means for designating a switching from a switch operation signal of the switching means to a signal for a time count function control when an output signal is generated from the signal holding means, time count setting means for delivering as a count value control instruction to the time count circuit the switch operating signal which is generated from the switching means, and means for releasing the hold state of the signal holding means after a time setting is effected at the time setting means and causing the switch operating signal from the switching means to be returned for normal time function control.

With an electronic timepiece in general, time counting is normally very accurate and, once a time adjustment is made, no great time adjustment is necessary. With this in mind this invention restricts such a time adjustment only to the case where a new battery is required for replacement.

According to this invention, a time setting operation which is substantially unnecessary during the normal time counting operation is effected only at a new battery incorporation time by using a switch means normally used for the control of a time counting function. During the normal time counting time a change of time and date data is inhibited, preventing an erroneous time count operation from being introduced into the timepiece, while positively holding a correct time.

DETAILED DESCRIPTION

One embodiment of this invention will now be described below by referring to the accompanying drawings.

Figure 1:
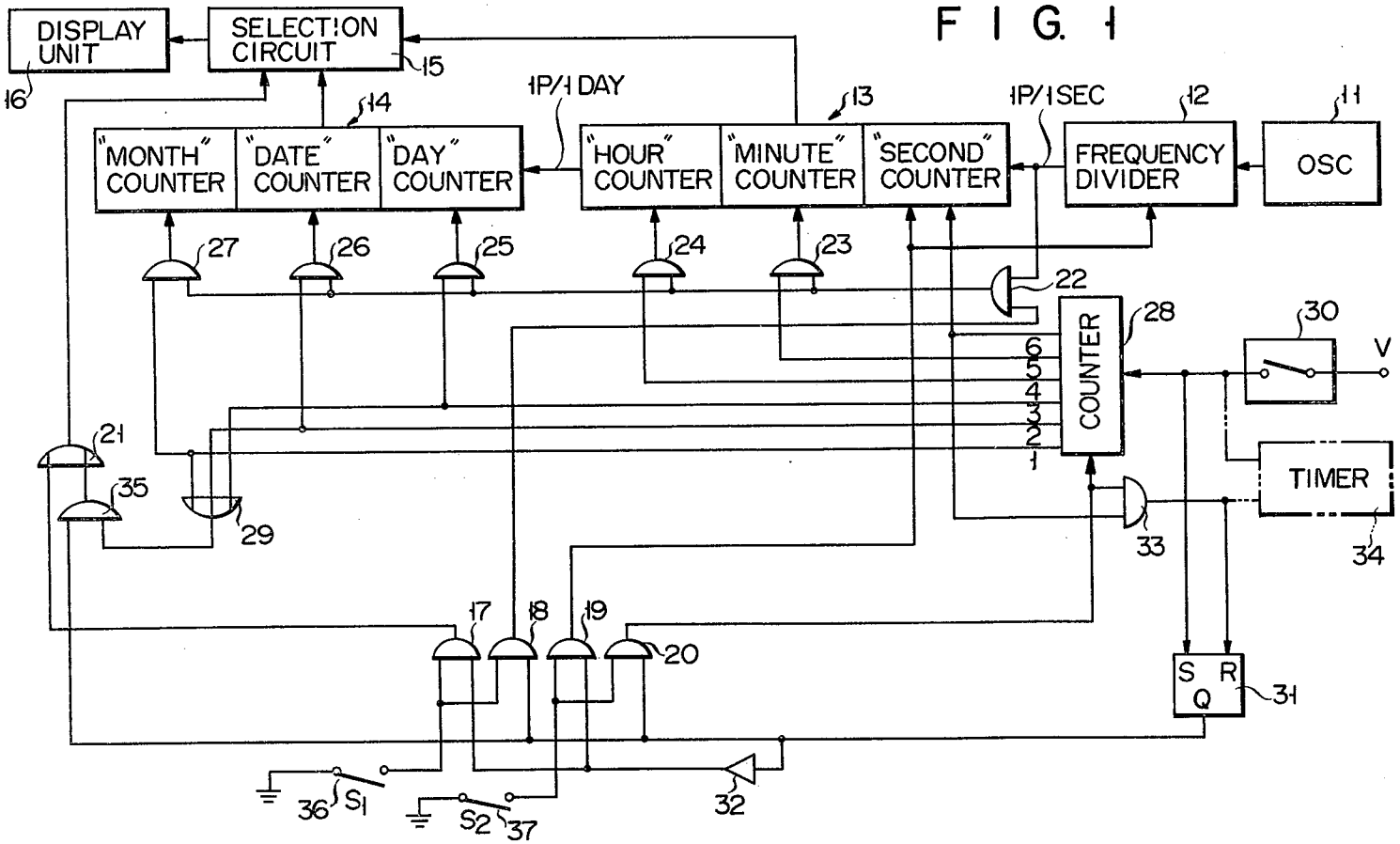
FIG. 1 is a block circuit diagram showing one embodiment of this invention.

In FIG. 1 a reference oscillator 11 comprises, for example, a crystal oscillator. The output signal of the oscillator 11 is frequency divided at a frequency divider 12 into, for example, a one pulse per second (1 P/1 sec) clock signal. The 1 P/1 sec signal of the frequency divider 12 is supplied as a time count signal to a time count circuit 13 having time count sections corresponding to hours, minutes and seconds, respectively. The time count circuit 13 generates a one pulse/per day (1 P/1 d) output signal. The 1P/1 d output signal of the time count circuit 13 is fed as a count step signal to a date count circuit 14 having date count sections corresponding to "months", "dates of the month" and "days of the week", respectively. The count output signals of the respective count sections in the time count circuit 13 and date count circuit 14 are coupled to a selection circuit 15. The count output signal of the time count circuit 13 is selected at the selection circuit 15 so that a time display is, for example, normally digitally effected at time display sections in a display unit 16 which correspond to "hours", "minutes" and "seconds", respectively.

First and second switches are usually used in an electronic timepiece to control the functions of the timepiece. The first and second switches 36 and 37 generate switch signals $S_1$ and $S_2$, respectively, upon operation. The first switch signal $S_1$ is supplied to AND circuits 17 and 18 and the second switch signal $S_2$ to AND circuits 19 and 20. The output signal of the AND circuit 17 is fed as a switching instruction signal to the selection circuit 15 through an OR circuit 21 and the signal of the date count circuit 14 is selected at the selection circuit 15 so that a date data including a month data, date-of-month data and day-of-week data is displayed on the time display sections in the display unit where a time data is usually indicated. The output signal of the AND circuit 19 is supplied as a clear instruction to the frequency divider 12 and time count circuit 13 (particularly to the "second" count section in the time count circuit 13) to enable a usual small time correction to be effected, by the second switch signal $S_2$, for example, in time units of seconds. In this case, it is needless to say that a time correction is done in the time count circuit 13 in time units of "a minute" and "second" so as to be consistent with the "second" data adjustment.

The output of the AND circuit 18 corresponding to the first switch signal $S_1$ is supplied as a gate signal to an AND circuit 22 to which the clock signal of the frequency divider 12 is coupled. The output signal of the AND circuit 22 is supplied to AND circuits 23, 24, 25, 26 and 27. The output signals of the AND circuits 23 and 24 are supplied as count step signals to the "minute" and "hour" count sections, respectively, in the time count circuit 13, and the output signals of the AND circuits 25, 26 and 27 are fed as count step signals to the "day-of-week", "data-of-month" and "month" count sections, respectively, in the date count circuit 14. When a count step signal is coupled by the signal of the AND circuits 23 to 27 to the count section of the time count circuit 13 and date count circuit 14, a carry signal from the lower order time unit section to the higher order time unit section is cut off, as required, and a count step control is effected only at the corresponding time unit section.

The AND circuits 23 to 27 are controlled according to the count value of, for example, a scale-of-six counter 28. The scale-of-six counter 28 has the contents stepped by a signl corresponding to the second switch signal $S_2$ of the AND circuit 20. For example, when the count value of the counter 28 is (1), a gate signal is applied to the AND circuit 27; when the count value is (2), a gate signal is applied to the AND circuit 26; when the count value is (3), a gate signal is applied to the AND circuit 25; when the count value is (4), a gate signal is applied to the AND circuit 24; when the count value is (5), a gate signal is applied to the AND circuit 23; and when the count value is (6), a clear instruction to the "second" count section in the time count circuit 13. The count value (1), (2) and (3) signals of the counter 28 are also connected through an OR circuit 29 and AND circuit 35 to the OR circuit 21 to permit the switching selection instruction to be applied to the selection circuit 15.

Figure 2:
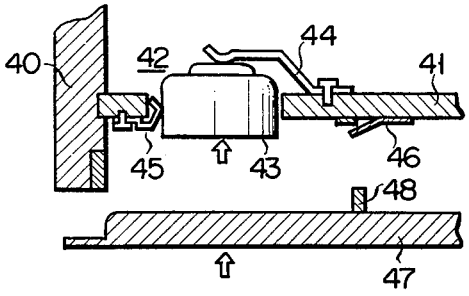
FIG. 2 is a cross-sectional view showing a major part of a battery mounting section.
Figure 3:
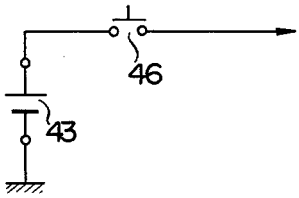
FIG. 3 is a wiring diagram of the battery mounting section shown in FIG. 2.
Figure 4:
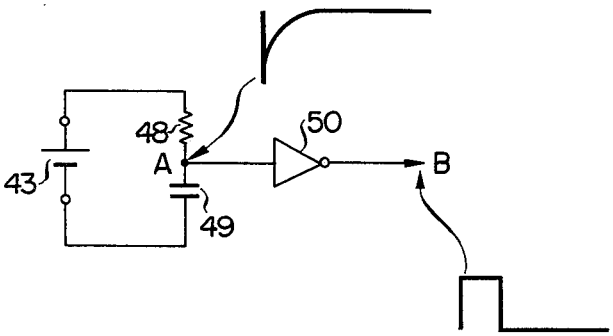
FIG. 4 is a wiring diagram showing one embodiment of an initial setting signal generating circuit in FIG. 1.

An initial setting signal generating means 30 for generating, for example, a trigger pulse-like signal is provided in the electronic timepiece so as to be ready for the incorporation of a new battery. The initial setting signal generating means 30 is constructed of a switch mechanism adapted to be driven when a back covering is closed after the incorporation of a battery into the body of the timepiece. That is, a battery 43 is incorporated, in a direction of arrows in FIG. 2, into the body of the timepiece through an opening 42 in a wiring board 41 supported on the inner surface of a casing 40. Contact pieces 44 and 45 are mounted on the wiring board 41 and when the battery is fitted into the body of the timepiece the circuit is in the ready state for drive. A contact piece of a switch 46 connected to the circuit is provided on the outer surface of the wiring board 41. A projection 48 is provided in the inner surface of the back covering so as to face the contact piece of the switch 46. Upon closure of the back covering in a direction indicated by arrows in FIG. 2 the switch 46 is closed to generate the above-mentioned initial setting signal. The contact piece of the switch 46 as shown in FIG. 3 may be manually operated before the battery is built into the body of the timepiece so that a power supply can be obtained. In another form of initial setting signal generating means 30, shown in FIG. 4, a rise of voltage is utilized which develops at a junction A between a resistor 48 and a capacitor 49 to generate a one-shot signal from a point B through a C-MOS inverter 50.

The initial setting signal of the initial setting signal generating means 30 is supplied as a reset instruction to the counter 28 and as a set instruction to a flip-flop circuit 31, which functions as a state holding means. The set output of the flip-flop circuit 31 is delivered as a gate signal to the AND circuits 18, 20 and 35 and it is also coupled to an inverter 32. The gates of the AND circuits 17 and 19 are controlled by the output signal of the inverter 32. The flip-flop circuit 31 is reset by the output signal of an AND circuit 33 to which are applied the count value (6) signal of the counter 28 and output signal of the AND circuit 20.

A timer device 34 to which the initial setting signal of the initial setting signal generating means 30 is coupled may be provided, as required, without using the AND circuit 33. In this case, the flip-flop circuit 31 is reset after a lapse of a predetermined time period from the generation of the initial setting signal.

With the battery incorporated into the body of the electronic timepiece an oscillation signal of the reference oscillator 11 is coupled through the frequency divider 12 to the time count circuit 13 for time counting and thence to the date count circuit 14 for date counting. The time count signal of the time count circuit 13 is coupled to the selection circuit 15 so that a time data including "hour", "minute" and "second" data are displayed at the display unit 16.

If in this state the first switch 36 is operated, a first switch signal $S_1$ is generated. Since at this time the flip-flop circuit 31 is in the reset state, an output signal is generated from the AND circuit 17 to permit a switching instruction to be applied to the selection circuit 15. That is, a switching from the time count data to the date count data is effected at the selection circuit 15 so that a date data is indicated on the display unit 16. If in the normal time counting state the second switch 37 is operated according to the time signal, a second switch signal $S_2$ is supplied to the AND circuit 19, the output of which is applied as an adjust instruction to the frequency divider 12 and the "second" count section in the time count circuit 13. As a result, a "second" correction is effected. That is, when the electronic timepiece performs a normal function, the first switch 36 is used to effect a switching from the time display to the date display and the second switch 37 is used to effect a time adjustment, for example, in time units of "seconds".

When a battery is removed from the electronic timepiece for replacement, the power supply to all the circuits associated with the time counting operation, display operation, etc. is interrupted, resulting in a discontinuance of the time counting operation and disappearance of all count values stored in the time count circuit 13 and date count circuit 14. Even when in this state a new battery is incorporated into the timepiece for power supply, no time or date count data appear on the display unit and a correct time and date setting is necessary.

With the new battery 60 incorporated into the body of the electronic timepiece the initial setting value generating circuit 30 generates an initial setting signal, causing the counter to be reset to an initial setting value while at the same time setting the flip-flop circuit 31 to permit a gate signal to be fed to the AND circuits 18, 20 and 35. The counter 28 delivers a count value "1" output signal to the AND circuit 27 and at the same time imparts an instruction through the OR circuit 29, AND circuit 35 and OR circuit 21 to the selection circuit 15 to permit a count value in the date count circuit 14 to be displayed at the display unit 16. If, this state, the first switch 36 is operated to cause a first switch signal $S_1$ to be generated, since at this time the oscillator 11 has already been driven, clock signals from the frequency divider 12 are coupled through the AND circuits 22 and 27 to the "month" count section in the date count circuit 14. During the operation of the first switch 36 the contents of the "month" count section in the date count circuit 14 is stepped by the clock signals of the frequency divider 12. That is, the "month" count value is set by the first switch 36.

When upon completion of a month setting operation the second switch 37 is operated to cause a second switch signal $S_2$ to be generated, the contents of the counter 28 are stepped. A count value "2" signal from the counter 28 is coupled as a gate signal to the AND circuit 26. The contents of the "date-of-month" count section in the date count section 14 are stepped by the first switch signal $S_1$ resulting from the operation of the second switch 37, so that a "date-of-month" data is set. Likewise, the contents of the counter 28 are stepped by the second switch signal $S_2$ so that a "day-of-week" data is set. The date display operation is completed while reviewing the date data in the date count section 14 in the display unit 14.

Then, a second switch signal $S_2$ is generated by the operation of the second switch 37. The contents of the counter 28 are sequentially stepped to (4) and (5) and the corresponding gate signals are delivered to the AND circuits 24 and 23, respectively. In this way, "hour" and "minute" data are set at the hour and minute count sections in the time count circuit 13 by the first switch signal $S_1$ of the first switch 36. Since at this time a signal is not supplied from the counter 28 to the OR circuit 29, the counted value of the time count circuit 13 is displayed at the display unit 16. In this case, the hour and minute setting operations are performed while reviewing the time display at the display unit 16.

Next when the contents of the counter 28 are stepped to (6) by the second switch signal $S_2$, the second count section in the time count circuit 13 is cleared, thus completing the time and date setting operations with respect to the time count circuit 13 and date count circuit 14. When in this state a second switch signal is generated according to the time signal, the contents of the counter 28 become (1) and a second counting is started. The AND circuit 33 generates an output signal, causing the flip-flop circuit 31 to be reset to permit the subsequent time and date adjusting operations to be inhibited. As a result, a gate signal is delivered to the AND circuits 17 and 19 so that a date display at the normal time count operation time and "second" adjusting operation can be effected respectively by the first and second switches.

With such an electronic timepiece, time counting is very accurately effected during the normal time counting operation. Once a time correction has been effected, no great time adjustment is necessary and, for example, it is only sufficient that a "second" adjustment will be made by the second switch signal $S_2$ from the second switch 37 so as to meet the time signal. In actual practice, a time adjustment is necessary only when a battery is initially inserted into the body of the timepiece or replaced by a new one. That is, the necessity for time adjustment is restricted to a battery replacement time or an original battery incorporation time. Stated more in detail, such time adjustment is done through a switching means normally used for the control of the time counting function and at this time a signal is generated from the initial setting signal generating circuit upon insertion of a new battery into the body of the timepiece. During the normal time counting time a change of the time and date display is inhibited and any erroneous display such as an erroneous time display is prevented from occuring due to an erroneous operation.

Although the time and date setting operations have been explained as effected during the time period required from the initial setting of the time and date data until the AND circuit 33 generates an output signal, when a timer device 34 is used, a time adjustment can be made during a time period as determined when the time and date data are initially set.

Although in the above-mentioned embodiment the time units "month", "date-of-month", "day-of-week", "hour", "minute" and "second" are sequentially selected using the scale-of-six counter, a very great amount of time will be required, since the time unit "minute" is based on a scale-of-six. In actual practice, however, it will be convenient to divide the minute count time into, for example, a "10-minute" unit and "1-minute" unit. In this way, the minute count time can be arbitrarily set. The switch means used in this invention includes not only a display change-over switch and a second adjusting switch as mentioned in the above-mentioned embodiment, but also may include another control switch such as an illumination switch for a liquid crystal timepiece and/or a control switch for a timepiece incorporating a stopwatch function, counter function, a global watch function, etc. A plurality of switch signals such as $S_1$ and $S_2$ can be arbitrarily obtained by a combination of a corresponding number of switches.

What is claimed is:

1. An electronic timepiece comprising:

means for receiving a battery, a time count circuit for counting reference clock signals from an oscillator, a display unit coupled to said time count circuit for displaying the contents of the time count circuit, switching means for controlling a time counting function except for a time setting function performed by said time count circuit, means for generating a battery set signal indicative of an initial state in which a battery is set into said battery receiving means of the timepiece, means coupled to said battery set signal generating means for holding the battery set signal from the battery set signal generating means, means coupled to said signal holding means for designating a switching from a switch operation signal of said switching means to a signal for a time count function control when an output signal is generated from said signal holding means, time count setting means for delivering as a count value control instruction to said time count circuit the switch operating signal which is generated from said switching means, and releasing means coupled to said signal holding means for releasing the hold state of said signal holding means after a time setting is effected at the time setting means and for causing the switch operating signal from said switching means to be returned for normal time function control.

2. An electronic timepiece according to claim 1, in which said releasing means is coupled to said battery set signal generating means so as to be operated by the battery set signal, said releasing means including:

time measuring means for measuring a predetermined time period in excess of a time required for time setting, and means for releasing the hold state of said signal holding means after said predetermined time period is measured by said time measuring means.

3. An electronic timepiece according to claim 1, in which said time count setting means includes:

count means corresponding in number to unit count sections in said time count circuit and in which the contents are counted stepwise by the switch operating signal which is generated from said designating means when the output signal is generated from said signal holding means, and means for releasing the hold state of said signa holding means when said count means is in its final count value state and the switch operating signal is present.

4. An electronic timepiece according to claim 1, in which said means for generating said battery set signal comprises a further switching means adapted to be driven when a battery is incorporated into said battery receiving means of the timepiece.

5. An electronic timepiece according to claim 2, in which said means for generating said battery set signal comprises a further switching means adapted to be driven when a battery is incorporated into said battery receiving means of the timepiece.

6. An electronic timepiece according to claim 3, in which said means for generating said battery set signal comprises a further switching means adapted to be driven when a battery is incorporated into said battery receiving means of the timepiece.

7. An electronic timepiece according to claim 1, in which said means for generating said battery set signal comprises manual switch means operated with a back covering of the timepiece opened and after a battery is incorporated into said battery receiving means of the timepiece.

8. An electronic timepiece according to claim 2, in which said means for generating said battery set signal comprises manual switch means operated with a back covering of the timepiece opened and after a battery is incorporated into said battery receiving means of the timepiece.

9. An electronic timepiece according to claim 3, in which said means for generating said battery set signal comprises manual switch means operated with a back covering of the timepiece opened and after a battery is incorporated into said battery receiving means of the timepiece.

10. An electronic timepiece according to claim 1, in which said means for generating said battery set signal comprises electronic switch means adapted to generate an electronic signal which rises when a battery is incorporated into said battery receiving means of the timepiece.

11. An electronic timepiece according to claim 2, in which said means for generating said battery set signal comprises electronic switch means adapted to generate an electronic signal which rises when a battery is incorporated into said battery receiving means of the timepiece.

12. An electronic timepiece according to claim 3, in which said means for generating said battery set signal comprises electronic switch means adapted to generate an electronic signal which rises when a battery is incorporated into said battery receiving means of the timepiece.

13. An electronic timepiece according to claim 2 wherein said time measuring means generates a release signal after measuring said predetermined time period.

14. An electronic timepiece according to claim 1 wherein said releasing means is coupled to said time count setting means and is responsive to said time count setting means reaching a predetermined count value to release said hold state of said signal holding means and to cause said switch operating signal to be returned for normal time function control.

15. An electronic timepiece according to claim 1 further comprising a removable cover which is closed after a battery is located in said battery receiving means, and wherein said battery set signal generating means comprises switch means operatively driven by said removable cover of the timepiece.

16. An electronic timepiece according to claim 15 wherein said cover is a rear cover of the timepiece.

17. An electronic timepiece according to claim 2 further comprising a removable cover which is closed after a battery is located in said battery receiving means, and wherein said battery set signal generating means comprises switch means operatively driven by said removable cover of the timepiece.

18. An electronic timepiece according to claim 17 wherein said cover is a rear cover of the timepiece.

19. An electronic timepiece according to claim 3 further comprising a removable cover which is closed after a battery is located in said battery receiving means, and wherein said battery set signal generating means comprises switch means operatively driven by said removable cover of the timepiece.

20. An electronic timepiece according to claim 19 wherein said cover is a rear cover of the timepiece.

* * * * *